US005746455A

United States Patent [19]

Takimoto

[11] Patent Number: 5,746,455

[45] Date of Patent: May 5, 1998

[54] GATE OR DOOR SPRING-BIASED BOLT LATCH

[75] Inventor: Kazuhide Takimoto, Tokyo, Japan

[73] Assignee: Takigen Manufacturing Co. Ltd., Tokyo, Japan

[21] Appl. No.: 857,123

[22] Filed: May 15, 1997

Related U.S. Application Data

[63] Continuation of Ser. No. 639,744, Apr. 29, 1996, abandoned.

[51] Int. Cl.[6] ..... E05C 5/02

[52] U.S. Cl. ..... 292/62; 292/145; 292/177

[58] Field of Search ..... 292/177, 163, 292/60, 61, 62, 69, 57, 145, DIG. 63

[56] References Cited

U.S. PATENT DOCUMENTS

| | | | |
|---|---|---|---|
| 901,470 | 10/1908 | Rankins | 292/61 |
| 1,315,266 | 9/1919 | Weiland | 292/60 |
| 1,675,033 | 6/1928 | Lefkovitz et al. | 292/60 |
| 2,295,021 | 9/1942 | Weiss | 292/61 |
| 2,357,608 | 9/1944 | Ostrowski | 292/60 |
| 3,397,000 | 8/1968 | Nakanishi | 292/62 |
| 3,626,507 | 12/1971 | Hawkins | 292/177 |
| 4,066,284 | 1/1978 | Ikemura | 292/62 |
| 4,744,392 | 5/1988 | Tade, III et al. | 292/61 |
| 5,042,854 | 8/1991 | Huang | 292/163 |
| 5,125,695 | 6/1992 | Hartwell | 292/62 |

FOREIGN PATENT DOCUMENTS

| | | | |
|---|---|---|---|
| 821074 | 9/1959 | United Kingdom | 292/145 |
| 840264 | 7/1960 | United Kingdom | 292/60 |
| 1075397 | 7/1967 | United Kingdom | 292/61 |

*Primary Examiner*—Rodney M. Lindsey
*Attorney, Agent, or Firm*—Martin Smolowitz

[57] ABSTRACT

In a bolt latch with a minimum number of parts, compact size, lightweight and operable by a snap action: socket 13 is fixable to stationary frame 1; latch body 3 has longitudinal groove 3*a* and circumferential groove 3*b*; latch body 3 is fixable to door 2, the groove 3*b* and is perpendicular to the groove 3*a*, communicates with and extends from a front end of the groove 3*a*; bolt 4 is in the latch body and is axially slidable and rotatable on its axis and engages with the socket 13 in locking operation; pin 5 is fixed to the bolt 4 and slidable slidably received in the grooves 3*a*, 3*b*; spring 6 linearly urges the bolt 4 to have its front end received in the latch body 3 and rotatably urges it to have the pin 5 received in the groove 3*b*; and seat 9 is fixed to the body 3 and butts against the pin 5 in an unlocking operation to prevent the bolt 4 from further moving rearward in the body 3.

5 Claims, 2 Drawing Sheets

GATE OR DOOR SPRING-BIASED BOLT LATCH

This application is a continuation, of application Ser. No. 08/639,744, filed Apr. 29, 1996 now abandoned.

BACKGROUND OF THE INVENTION

1. Field of the Invention

The present invention relates to a gate or door spring-biased bolt latch which may be locked and unlocked by a snap action.

2. Description of the Prior Art

In a conventional gate or door bolt latch: a socket member is fixedly mounted on a stationary frame element; a latch body, which assumes a substantially sleeve-like shape, is provided with a longitudinal groove and a circumferential groove in its outer peripheral portion, which circumferential groove communicates with and extends from a front-end portion of the longitudinal groove in a direction perpendicular to the longitudinal groove, the latch body being fixedly mounted on a gate or door; a bolt is movably mounted in the latch body in an insertion manner so as to be longitudinally slidable and rotatable on its longitudinal axis relative to the latch body; and, a control pin is fixedly mounted on the bolt to slidably move along the length of each of the longitudinal groove and the circumferential groove of the latch body.

However, the conventional gate or door bolt latch having the above construction requires two motions not only in its locking operation but also in its unlocking operation, and, therefore in this respect it is cumbersome in operation. Namely, in the locking operation, it is necessary for the conventional latch to: first, linearly move the control pin forward in the longitudinal groove until a front-end portion of the bolt engages with the socket member; and, then rotatably move the control pin in the circumferential groove to lock the bolt to the socket member.

Further, the conventional latch is also disadvantageous in that: the control pin is prone to catch clothes and the like after the latch is unlocked to release a gate or door; and, a front-end portion of the bolt extends outward from the latch body to hit the socket member and the gate or door and the like, which damages the socket member, the latch body and the like.

SUMMARY OF THE INVENTION

It is an object of the present invention to provide a gate or door spring-biased bolt latch which is locked and unlocked in operation by a single motion without fail, the latch requiring the minimum number of components and being compact in size and light in weight for being fixedly mounted onto a door or gate.

The above object of the present invention is accomplished by providing:

a gate or door spring-biased bolt latch comprising:

a socket member for fixedly mounting on a stationary frame element;

an elongated latch body assuming a sleeve-like shape provided with a longitudinal groove and a circumferential groove in its outer peripheral portion, the latch body being fixedly mounting on a gate or door, the circumferential groove being perpendicular to the longitudinal groove, and communicating with and extending from a front-end portion of the longitudinal groove;

a bolt movably mounted in the latch body in an insertion manner so as to be axially slidable and rotatable on its axis relative to the latch body, the bolt being engabeable with the socket member in a locking operation of the bolt latch;

a control pin fixedly mounted radially on the bolt and slidably received in the longitudinal groove and the circumferential groove of the latch body, the control pin being slidable along the length of each of the longitudinal groove and the circumferential groove;

a spring which linearly urges the bolt to have its front-end portion received in the latch body and rotatably urges the bolt to have the control pin received in the circumferential groove of the latch body; and a seat member which is fixedly mounted in the latch body and butts against the control pin in an unlocking operation of the bolt latch to prevent the bolt from further moving rearward in the latch body.

Other objects and advantages of the present invention will be readily apparent to those skilled in the art from a reading of the following brief description of the drawings, the description of the preferred embodiment, and the appended claims.

DESCRIPTION OF THE PREFERRED EMBODIMENT

Hereinbelow, the present invention will be described in detail with reference to the accompanying drawings.

Figure 1:
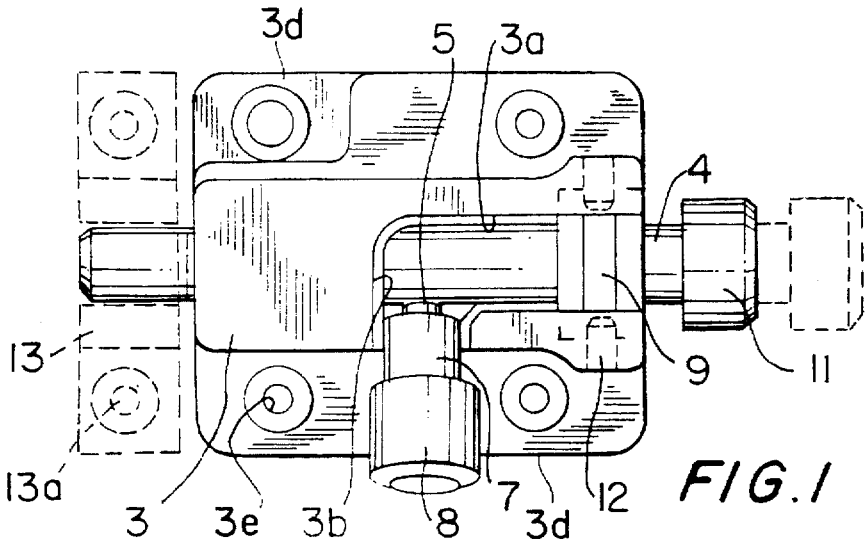
FIG. 1 is a front plan view of an embodiment of the spring-biased bolt latch of the present invention in its locking position for mounting on a door or gate.
Figure 2:
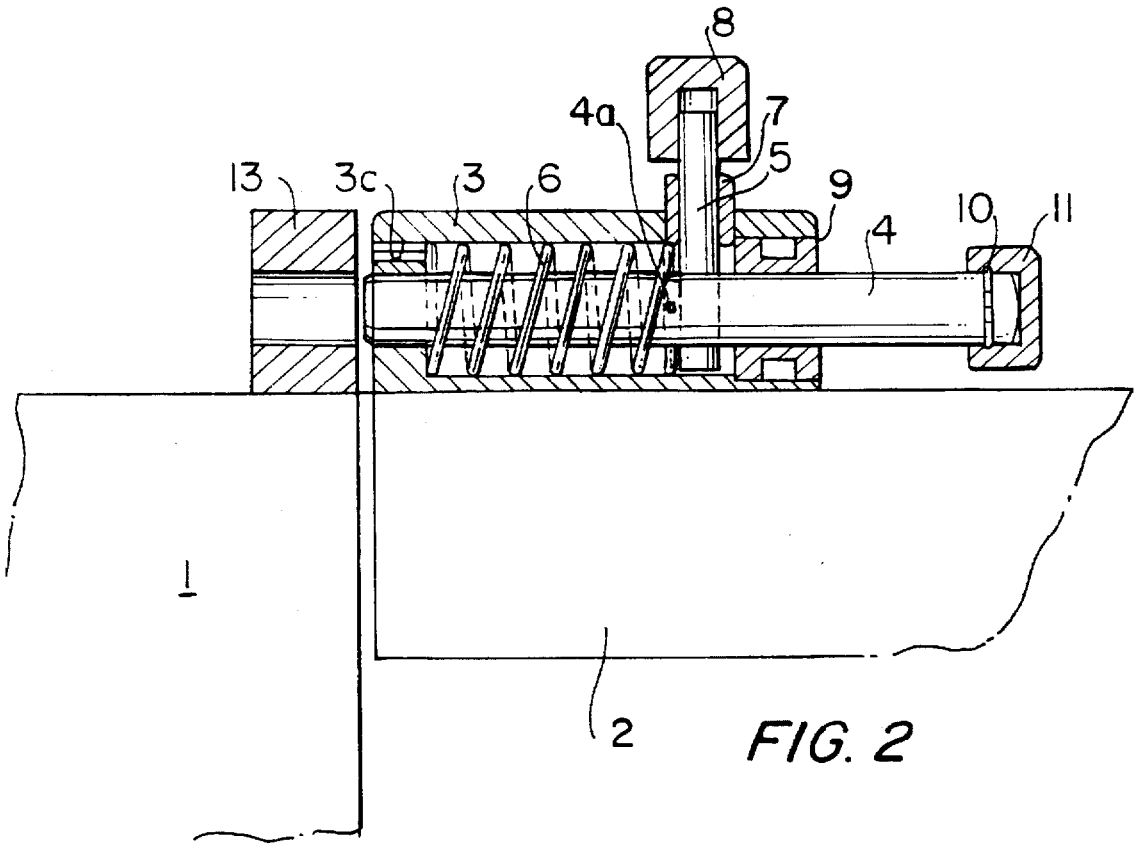
FIG. 2 is a partially longitudinal sectional view taken along the central axis of the bolt latch of the present invention shown in FIG. 1 in its unlocking position and fixedly mounted on a door or gate.
Figure 3:
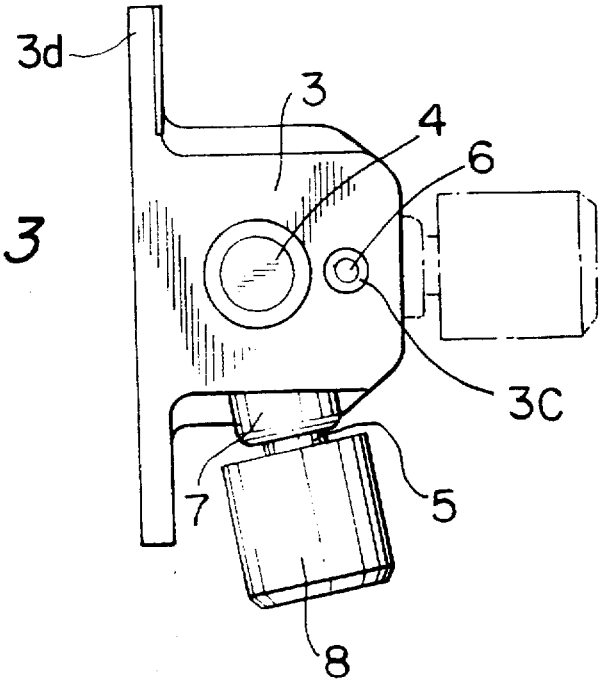
FIG. 3 is a left side view of the bolt latch of the present invention shown in FIG. 1.
Figure 4:
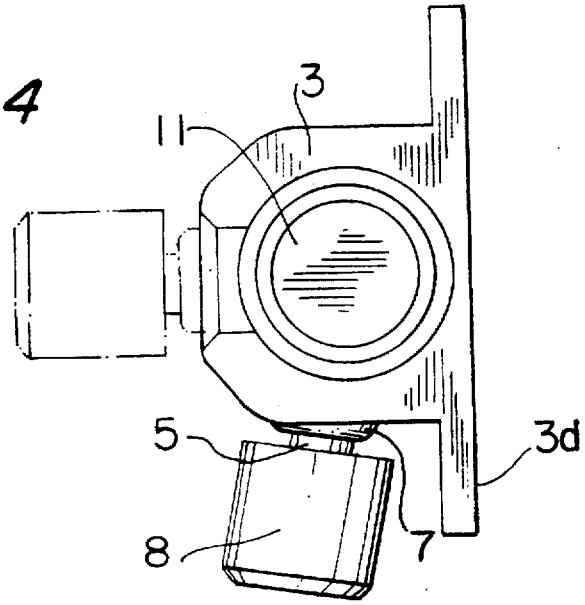
FIG. 4 is a right side view of the bolt latch of the present invention shown in FIG. 1.

As is clear from FIGS. 1 and 2, in a gate or door spring-biased bolt latch of an embodiment of the present invention, a socket member 13 is fixedly mounted on a stationary frame element 1 by suitable fastening means such as a screw inserted in dual mounting holes 13*a*.

An elongated latch body 3 of the bolt latch of the present invention assumes a sleeve-like shape, which is provided with a longitudinal groove 3*a* and a circumferential groove 3*b* in its outer peripheral portion. The latch body 3 is fixedly mounted on a gate or door 2. The circumferential groove 3*b* is perpendicular to the longitudinal groove 3*a*, and communicates with and extends from a front-end portion of the longitudinal groove 3*a*.

A bolt 4 of the bolt latch of the present invention is movably mounted in the latch body 3 in an insertion manner, so as to be axially slidable and rotatable on its axis relative to the latch body 3. The bolt 4 engages with the socket member 13 in locking operation of the bolt latch.

A control pin 5 of the bolt 4 is fixedly mounted radially on the bolt 4 and slidably received in each of the longitudinal groove 3*a* and the circumferential groove 3*b* of the latch body 3. The control pin 5 is slidable along the length of each of the longitudinal groove 3*a* and the circumferential groove 3*b* of the latch body 3.

A spring 6 is slidably mounted in the front-end portion of the latch body 3, linearly urges the bolt 4 to have its front-end portion received in the latch body 3, and the socket member 13, and then rotatably urges the bolt 4 to have the control pin 5 received in the circumferential groove 3*b* of the latch body 3.

A seat member 9 is fixedly mounted in the latch body 3 rear-end portion and butts against the control pin 5 in unlocking operation of the bolt latch, to prevent the bolt 4 from further moving rearward in the latch body 3.

In locking operation, a base-end portion of the bolt 4 is pushed against a resilient force exerted by the spring 6, so that a front-end portion of the bolt 4 is engaged with the socket member 13. At this time, the control pin 5 is slidably moved forward in the longitudinal groove 3*a* of the latch body 3. Therefore, the bolt 4, to which the control pin 5 is initially fixed, is prevented from rotating on its axis even when subjected to torque exerted by the spring 6. After completion of engagement of the front-end portion of the bolt 4 with the socket member 13, the control pin 5 is positioned in a front-end portion of the longitudinal groove 3*a*, and, therefore pushed into the circumferential groove 3*b* under the influence of the above-mentioned torque exerted by the spring 6 on the bolt 4, which permits the bolt 4 to rotate on its axis and permits the control pin 5 to reach the other end of the circumferential groove 3*b*. As a result, the bolt 4 is prevented from axially moving rearwardly in the longitudinal groove 3*a* of the latch body 3.

In unlocking operation, the control pin 5 is forcibly rotated along the length of the circumferential groove 3*b* against the torque exerted by the spring 6 on the bolt 4. When the control pin 5 reaches the front-end portion of the longitudinal groove 3*a*, the bolt 5 is axially and slidably moved by the spring 6 in the longitudinal groove 3*a* rearward to have its front-end portion disengaged from the socket member 13, which unlocks the bolt latch of the present invention to permit the gate or door to open.

In the embodiment of the bolt latch of the present invention having the above construction, in order to realize a smooth sliding motion of the control pin 5, a collar 7 is rotatably mounted on the control pin 5 so as to have the collar outer surface rotatably contact both the longitudinal groove 3*a* and the circumferential groove 3*b*, as shown in FIG. 2. Further, in order to improve the control pin 5 of the bolt 4 in operability, a knob 8 is fixedly mounted on an outer-end portion of the control pin 5. For the same purpose, a push button 11 is rotatably mounted on a rear-end portion of the bolt 4 through a retaining ring 10 which prevents the push button 11 from dropping out from the rear-end portion of the bolt 4. On the other hand, the spring 6 is constructed as a coil spring which linearly and rotatably urges the bolt 4, has its front-end portion engaged with a mounting hole 3*c* of a front-end portion of the latch body 3, and has its base-end portion engaged with another mounting hole 4*a* of an intermediate portion of the bolt 4, and, therefore the spring 6 serves not only as a compression spring but also as a torsion spring. The sleeve-like latch body 3 is provided with a dual flange portions 3*d* in which a plurality of mounting holes 3*e* are formed for fixedly mounting the latch body 3 onto a door or gate 3 by screws. The seat member 9, which restricts a rearward motion of the bolt 4, is fixedly but removably mounted on the latch body 3 through at least one set screw 12.

In operation, it is possible for the user to lock and unlock the bolt latch of the present invention by a snap action, because of its construction described above, in which: the longitudinal groove 3*a* and the circumferential groove 3*b* are formed integrally in the outer peripheral portion of the sleeve-like latch body 3, the circumferential groove 3*b* communicating with and extending from the front-end portion of the longitudinal groove 3*a* in a direction perpendicular to the longitudinal groove 3*a*; the bolt 4 is inserted in the latch body 3 so as to be axially slidable and rotatable on its axis relative to the latch body 3; the control pin 5 is fixedly mounted on the bolt 4 and permitted to slidably move in both the longitudinal groove 3*a* and the circumferential groove 3*b*; and, the spring 6 slidably and rotatably urges the bolt 4 so that its front-end portion withdraws into the latch body 3 as the control pin 5 leaves the circumferential groove 3*b* and enters the longitudinal groove 3*a*.

The spring 6 for slidably and rotatably urging the bolt 4 is constructed as a coil spring which has its front-end portion engaged with the mounting hole 3*c* of the front-end portion of the latch body 3, has its rear- or base-end portion engaged with the mounting hole 4*a* of the intermediate portion of the bolt 4. Consequently, a single piece spring 6 serves not only as a compression spring but also as a torsion spring, which enables the bolt latch of the present invention to reduce the number of its components and to be compact in size and light in weight.

In a condition in which the bolt latch of the present invention is unlocked, since the bolt 4 has its front-end portion entirely withdrawn into the latch body 3 without fail under the influence of a resilient force exerted by the spring 6, there is no fear that the socket member 13 and the latch body 3 are damaged by the bolt 4.

What is claimed is:

1. A spring-biased bolt latch for fixedly mounting onto a door or gate, the latch comprising a socket member (13) suitable for fixedly mounting on a stationary frame element (1);

an elongated latch body (3) having a front end portion and a rear end portion, and having dual flange portions (3*d*) for fixedly mounting on a door or gate (2) said latch body being provided with a longitudinal groove (3*a*) and a circumferential groove (3*b*) in the latch body outer peripheral portion, said circumferential groove (3*b*) being perpendicular to said longitudinal groove (3*a*) and communicating with and extending from a front-end portion of said longitudinal groove (3*a*);

a bolt (4) movably mounted in said elongated latch body (3) so as to be axially slidable and rotatable on its axis relative to said latch body (3), said bolt (4) having a rear-end portion extending from said latch body (3) rear end portion and having a front-end portion for engaging with said socket member (13) in a locking operation of the bolt latch; said bolt (4) having a push button (11) rotatably mounted on the rear end portion of the bolt (4) by a retaining ring (10);

a control pin (5) fixedly mounted radially on said bolt (4) and received in said longitudinal groove (3*a*) and said circumferential groove (3*b*) of said latch body (3) so as to be slidable along the length of each said longitudinal groove (3*a*) and said circumferential groove (3*b*); said control pin (5) having a knob (8) fixedly mounted on an outer end portion of the control pin (5);

a coil and torsion spring (6) which is slidably mounted in said latch body (3) front end portion and linearly urges said bolt (4) to have its front-end portion received in said latch body (3) and rotatably urges said bolt (4) to have said control pin (5) received in said circumferential groove (3*b*) of said latch body (3);

said spring (6) having a front end portion which is engaged with a mounting hole (3*c*) in said latch body (3) front end portion and having base end portion which is engaged with a mounting hole (4*a*) of said bolt (4), so as to serve both as a compression and torsion spring; and a seat member (9) which is mounted in said latch body (3) rear-end portion by a set screw (12) and butts against said control pin (5) in unlocking operation of the bolt latch (3) to prevent said bolt (4) from further moving towards the rear-end portion in said latch body (3).

2. A spring biased bolt latch according to claim 1, wherein a collar (7) is rotatably and non-threadably mounted on said control pin (5), so that the rotatable collar outer surface rotatably contacts said longitudinal groove (3*a*) and said circumferential groove (3*b*).

3. A spring-biased bolt latch according to claim 1, wherein said socket member (13) is fixedly mounted on a stationary frame element (1) and said latch body (3) is fixedly mounted on a door (2) by fastening means.

4. A spring-biased bolt latch fixedly mounted on a door or gate, comprising:

a socket member (13) fixedly mounted on a stationary frame element (1);

an elongated latch body (3) having a front-end portion and a rear-end portion and having dual flange portions (3*d*) being fixedly mounted on said door or gate (2), said latch body being provided with a longitudinal groove (3*a*) and a circumferential groove (3*b*) in the latch body outer periphery portion, said circumferential groove (3*b*) being perpendicular to said longitudinal groove (3*a*) and communicating with and extending from a front-end portion of said longitudinal groove (3*a*);

a bolt (4) movably mounted in said elongated latch body (3) so as to be axially slidable and rotatable on its axis relative to said latch body (3), said bolt (4) having a rear-end portion extending from said latch body (3) rear end portion and having a front-end portion for engaging with said socket member (13) in locking operation of the bolt latch; said bolt (4) having a push button (11) rotatably mounted on the rear end portion of said bolt (4) by a retaining ring (10);

a control pin (5) fixedly mounted radially on said bolt (4) and received in said longitudinal groove (3*a*) and said circumferential groove (3*b*) of said latch body (3) so as to be slidable along the length of each said longitudinal groove (3*a*) and said circumferential groove (3*b*); said control pin (5) having a knob (8) fixedly mounted on an outer end portion of the control pin (5);

a coil and tension spring (6) which is slidably mounted in said latch body (3) front-end portion and linearly urges said bolt (4) to have its front-end portion received in said latch body (3) and rotatably urges said bolt (4) to have said control pin (5) received in said circumferential groove (3*b*) of said latch body (3);

said spring (6) having a front-end portion which is engaged with a mounting hole (3*c*) in said latch body (3) front-end portion and having a base end portion which is engaged with a mounting hole (4*a*) of said bolt (4), so as to serve both as a compression and a torsion spring; and a seat member (9) which is mounted in said latch body (3) rear end portion by a set screw 12 and butts against said control pin (5) in unlocking operation of the bolt latch to prevent said bolt (4) from further moving towards the rear-end portion in said latch body (3).

5. A spring-biased bolt latch according to claim 4, wherein a collar (7) is rotatably and non-threadably mounted on said control pin (5), so that the collar outer surface rotatably contacts said longitudinal groove (3*a*) and said circumferential groove (3*b*).

* * * * *